US005615865A

United States Patent [19]

Fountain

[11] Patent Number: 5,615,865

[45] Date of Patent: Apr. 1, 1997

[54] AUTOMATICALLY ENGAGING AND DISENGAGING PAWL AND PULLEY LIFTING MECHANISM

[76] Inventor: Edward Fountain, 27 Riverview Ave., Ardsley, N.Y. 10502

[21] Appl. No.: 400,562

[22] Filed: Mar. 8, 1995

[51] Int. Cl.[6] ..... B66D 1/00

[52] U.S. Cl. ..... 254/391; 254/269

[58] Field of Search ..... 254/391, 408, 254/269

[56] References Cited

U.S. PATENT DOCUMENTS

| | | | |
|---|---|---|---|
| 152,635 | 6/1874 | Hewitt et al. | 254/391 |
| 579,799 | 3/1897 | Kester | 254/269 |
| 723,231 | 3/1903 | Benedict | 254/391 |
| 2,200,896 | 5/1940 | Rio | 254/391 |
| 4,934,660 | 6/1990 | Nelson | 254/408 |

*Primary Examiner*—Katherine Matecki

[57] ABSTRACT

A pulley is mounted in a surrounding hanging housing, open at the base end thereof and a cable is entrained over the pulley. The cable is provided with a pull means at one end the other end carries a load. Near each end of the cable are tripping brackets engaging a lever mechanism pivoted from the lower portion of the housing. The lever mechanism engages a pivoted tooth pawl. When the lever is tilted one way the pawl engages the load side of the cable to hold it in place when there is no pull on the other side. When the tripping bracket on the load side of the cable reaches the lower edge of the lever it tilts the right side of the lever upwardly which in turn engages a transverse pin on the pawl to move the end of the pawl teeth away from the load side cable and allow the load to descend. When the bracket on the pull side of the cable has risen to the lower left edge of the lever, the lever is tilted towards the load side allowing the pawl to engage the load side of the cable. This mechanism provides a means for safely lifting loads manually to heights above the user and automatically locking or holding the load in place. It has the capability to automatically release the locking mechanism to allow the load to descend towards the user and again allow the locking pawl to engage the load side of the cable.

1 Claim, 4 Drawing Sheets

AUTOMATICALLY ENGAGING AND DISENGAGING PAWL AND PULLEY LIFTING MECHANISM

BACKGROUND OF THE INVENTION

1. Field of the Invention

This invention relates to pulley mechanisms for lifting loads and in particular to a pulley mechanism that as the load is lifted and a pause is made between the lower and the upper lifting limits, a pawl engages the rope or cable to hold the load in place while there is no lifting force at work.

In most cases such pawl arrangements must be manually disengaged to release the load, but in the present case there is provided a mechanism for automatically releasing the pawl lock when it reaches a predetermined height, and, in a similar manner, to automatically reset the engaging mechanism when the lifting line reaches a certain predetermined position.

2. Prior Art

U.S. Pat. No. 1,389,514 Kestell discloses an automatic locking pulley with a housing. The pulley is mounted on a supporting lever which is fulcrumed at its lower portion and can be tilted outside the housing in an opening. The pulley revolves on a pintle and the rope is trained over the pulley. The lower end of the supporting lever is angled and serrated with teeth.

In this case either the rope on the load side or the pulling side must be pulled to the side and a lever tilted to the side, locking the rope or releasing the rope to let the load down. The changing from locking to release and vise versa is accomplished by side pulls on the ends of the rope that is either pulling or loaded.

U.S. Pat. No. 2,608,174 Sponenburg discloses an adjustable safety device for a boat anchor with an automatic locking member engaging the rope to prevent it moving downward. If an adjustment is necessary the rope is pulled to the side and moves within a recess in the locking member.

Various other disclosures of rope or cable clamps in combination with pulleys are shown in the following references:

| | |
|---|---|
| U.S. Pat. No. 1,107,934 Hagan | U.S. Pat. No. 4,097,023 Muller |
| U.S. Pat. No. 1,167,295 Hall | U.S. Pat. No. 4,502,668 Dodge, Jr. |
| U.S. Pat. No. 2,867,875 Davison | U.S. Pat. No. 5,521,000 Dodge, Jr. |
| | U.S. Pat. No. 4,542,884 Dodge, Jr. |

None of the foregoing references are structurally similar to the device of the present invention or accomplish the end goals in the same manner nor as efficiently.

SUMMARY OF THE INVENTION

In the device of the present invention a pulley is mounted within a surrounding housing open at the base end thereof with a rope or cable entrained over the pulley. Means are provided on the upper part of the housing for suspending the housing from above. A pull means on both end portions of the rope or cable is provided. A load is placed at one end and at the other end is a pull fixture.

Separate tripping brackets or other means for engaging the release mechanism described below may be placed at either end portion of the rope in lieu of the pull ring or the load itself as may be the case.

At the lower end of the housing, pivotally mounted on a pivot attached to the housing is a lever mechanism, and on the same pivot, a toothed pawl for engaging the load side of the rope is mounted with the pawl having a transverse pin to engage the lever. The pin is moveable through an arced slot in the sides of the housing.

Normally, when loaded, on each pull and release of the load, the toothed end of the pawl engages the load side of the rope to prevent it from moving downwardly when the rope is released. When the load reaches a predetermined height, either the load or an intermediate clamp on the load side of the rope engages one end of the lower side of the lever, the top of which in turn at the lower edge of the slot engages the pin to thereby move the pawl teeth away from the rope, allowing the load to train downwardly. When the pull ring or other means engages the opposite end of the lever, it is tilted upwardly at the end and downwardly on the load side, allowing the pin to move downwardly in the arced slot and thereby allowing the teeth of the pawl to reengage the rope on the load side.

This mechanism provides an easy and useful means for safely lifting loads manually to heights above the user and automatically locking or holding in place, then being able to automatically release the locking mechanism to allow the load side to descend to the user, and then when the pull end of the rope reaches the tiltable lever to reengage or reactivate the pawl locking mechanism.

BRIEF DESCRIPTION OF THE DRAWING

In the accompanying drawing which forms a part of the specification.

ILLUSTRATIVE SPECIFIC EMBODIMENT

Figure 1:
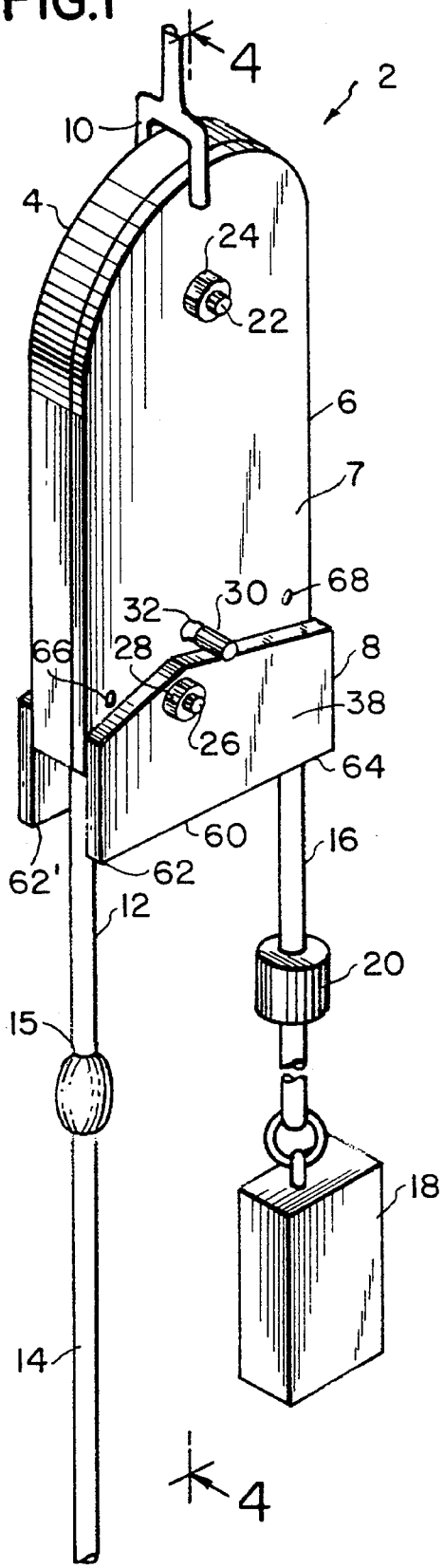
FIG. 1 is an overall perspective view of the mechanism of the present device wherein a load is being lifted.

Referring to the accompanying drawing the device of the present invention is indicated in general at 2 and comprises enclosure 4 having front and back covers 6 and 7 respectively and lever device 8 is which is pivoted on the shaft 26 on the lower part of enclosure 4.

At the top of the enclosure 4 a hanging bracket 10 is provided for suspending the device 2 from an overhead support (not shown). Depending from the device 2 is a rope or cable 12 having a pull side 14 and a load side 16. A load 18 is suspended from the end 16 of the rope 12. A stop 20 on the rope or cable 16 is provided to engage the lower edges 60 and 60' of the lever 8 at the tilted position shown in FIG. 2. Bolt 22 and nut 24 hold the sides 6 and 7 together as well as suspend the pulley 46, the bolt 22 passing through central aperture 56 of pulley 46 and aperture 58 of cover 6. The bolt 26 and nuts 28 also are utilized to hold the enclosure together 4, bolt 26 also providing a pintle means for the lever 8 and pawl 50. The pin(s) 30 and 30' carried on the pawl 50 extend through arcuate slot(s) 32 and 32' formed in the covers 6 and 7 of the enclosure 4.

The lever 8 includes sides 36 and 38 and with bases 60 and 60' open between the ends 62 and 62' and 64 and 64' to allow the rope sections 14 and 16 to extend down through. The sides 38 and 36 are connected by beam 54. The side 38 has slanted top edges 82 and 84 and side 36 has slanted top edge 82' and 84' as shown.

The upper portion of enclosure 4 has an arc 42 shape through which the rope 12 is curved as shown and has a recess 44 therein about the interior side to accommodate the rope 12 entrained over the pulley 46 having the track 48.

Figure 4:
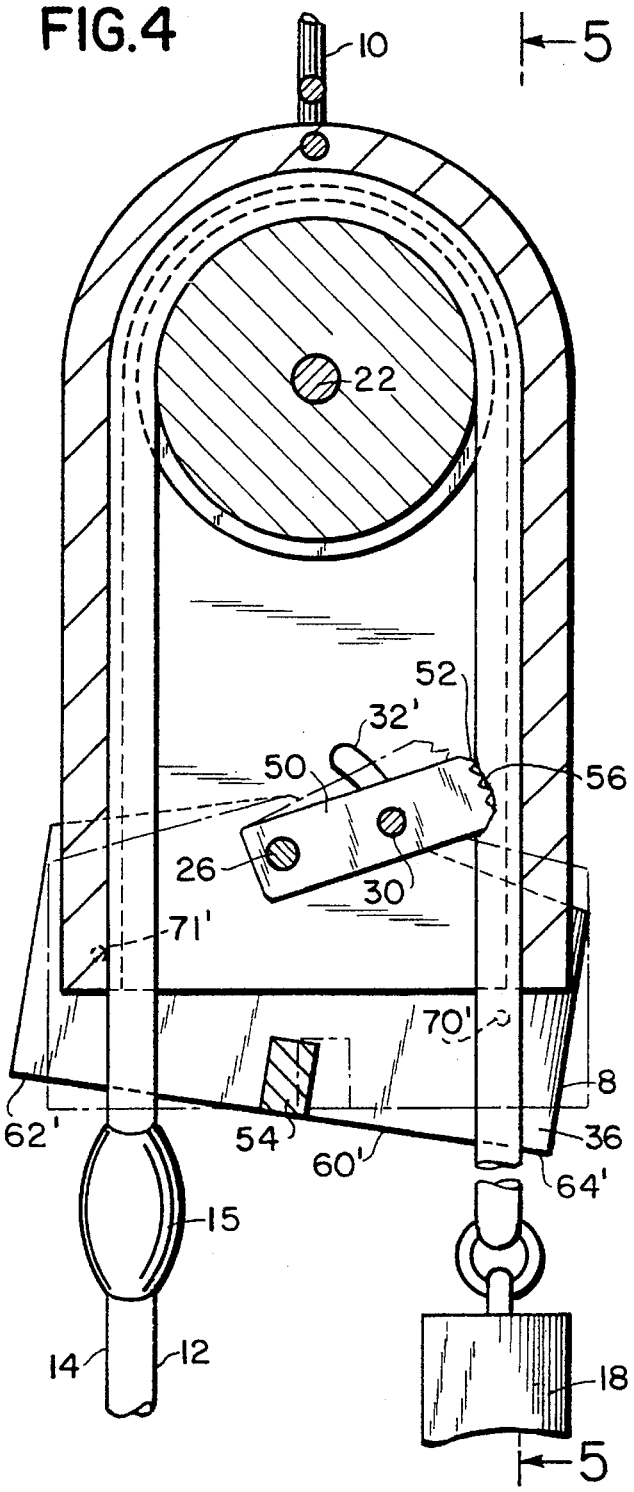
FIG. 4 is a sectional view along lines 4—4 of FIG. 1.

Pivoted on the bolt 26 is pawl 50 with aperture 51 and teeth 52 which will engage the upper part of rope 12 at 56 on the load side 16 and press against the side of the enclosure 4 as indicated best in FIG. 4.

Figure 6:
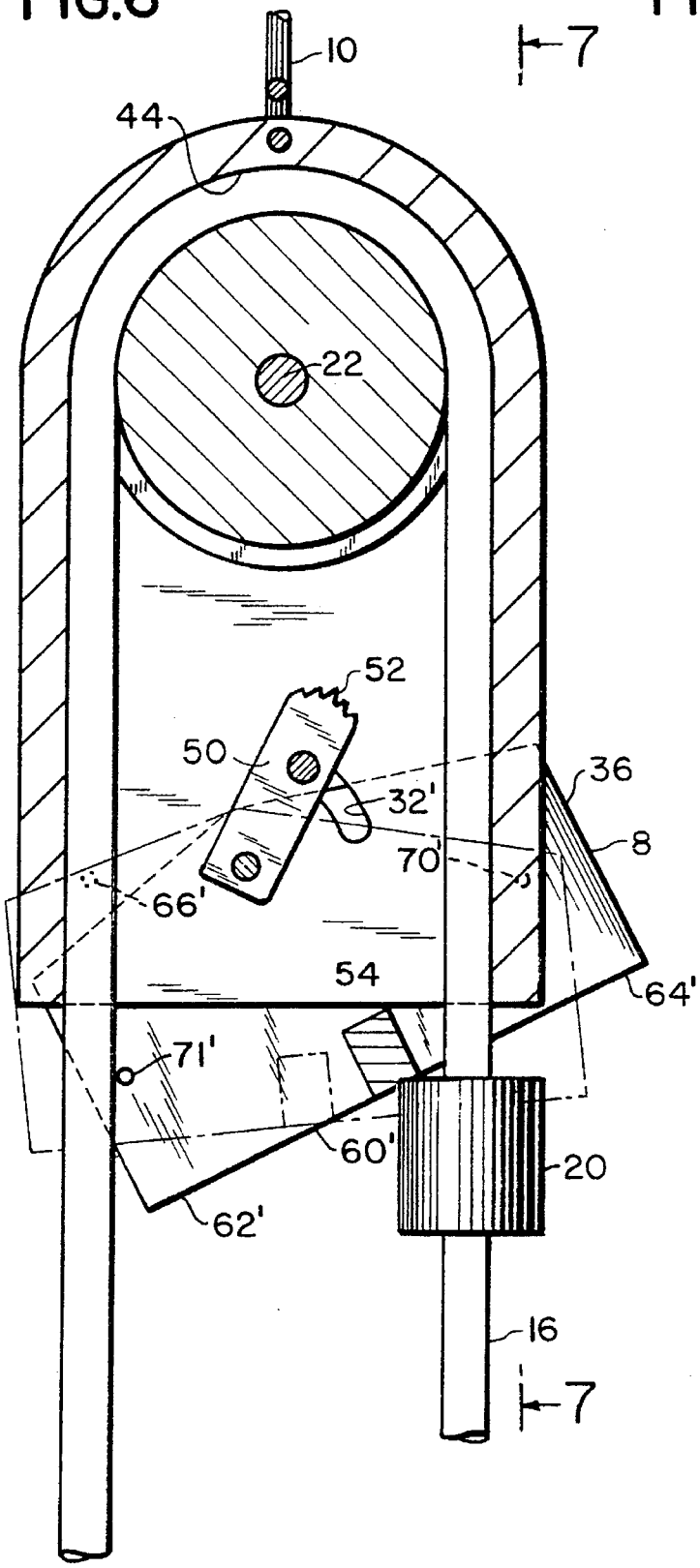
FIG. 6. is a side plan view, partially exposed showing the operation of the load side clamps engaging lever.
Figure 7:
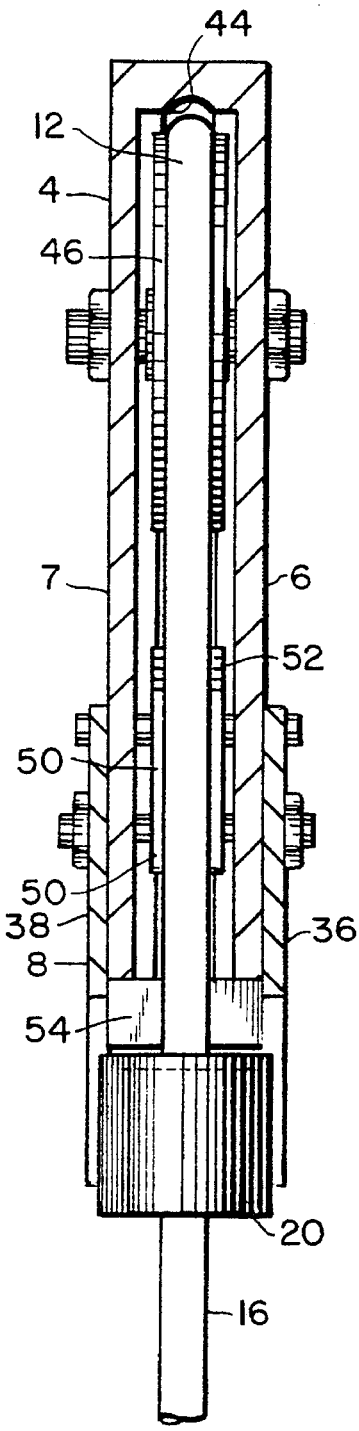
FIG. 7 is a view along lines 7—7 of FIG. 6.

As shown in FIGS. 6 and 7 stops 15 and 20 are crimped or bolted or otherwise secured to the cable 12 on sides 16 and 14.

The device 2 is designed so that when the load 18 is lifted and the pulling force released, the serrated teeth 52 of pawl 50 engage the cable 12 to prevent it from moving downwardly on side 16 when the lifting force is released.

Figure 2:
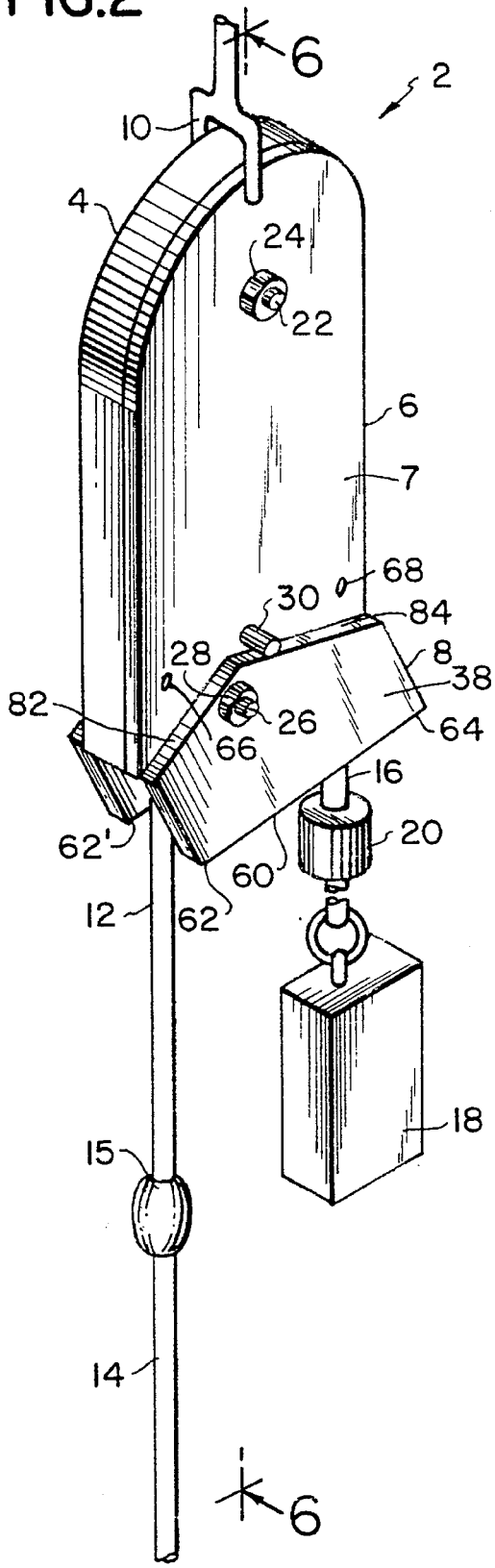
FIG. 2 is similar to FIG. 1 where the load being lifted has reached a point just below the device and activated and tilted the lever to disengage the stop pawl.
Figure 3:
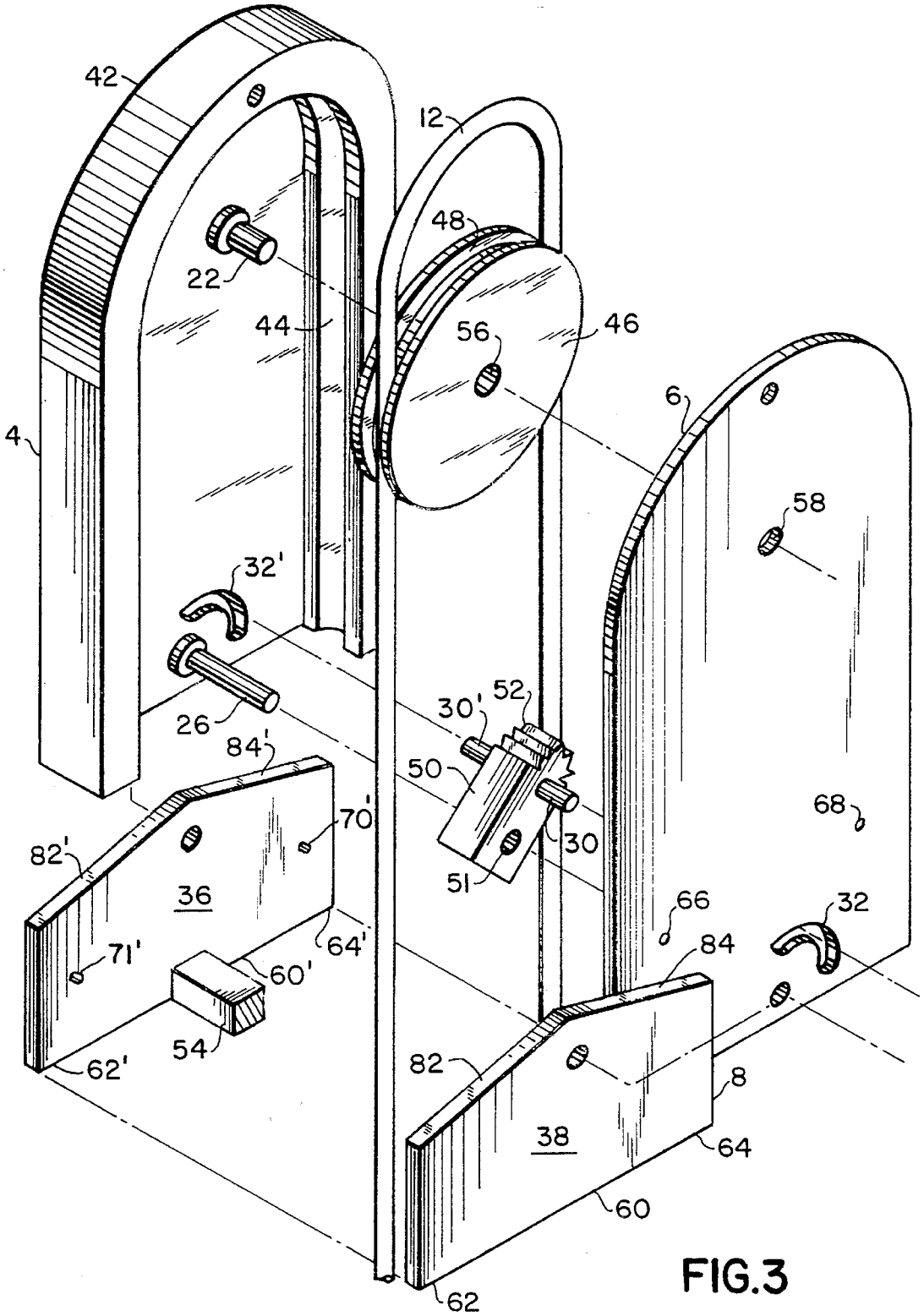
FIG. 3 is a perspective view of the component parts of the device disassembled.

When the load 18 or the stop 20 reaches the edges 64 and 64' of lever 8 indicated at FIGS. 2 and 6 on the lower sides 60 and 60' of the lever 8, the lever 8 tilts to a position shown in FIGS. 2, 6, and 7 to cause the release of the serrated teeth 52 of the pawl 50, by edges 84 and 84', moving pins 30 and 30' upward in arcs 32 and 32' and allowing the load 18 or load end 16 of the cable 12 to be returned to the position indicated in FIG. 1.

Figure 5:
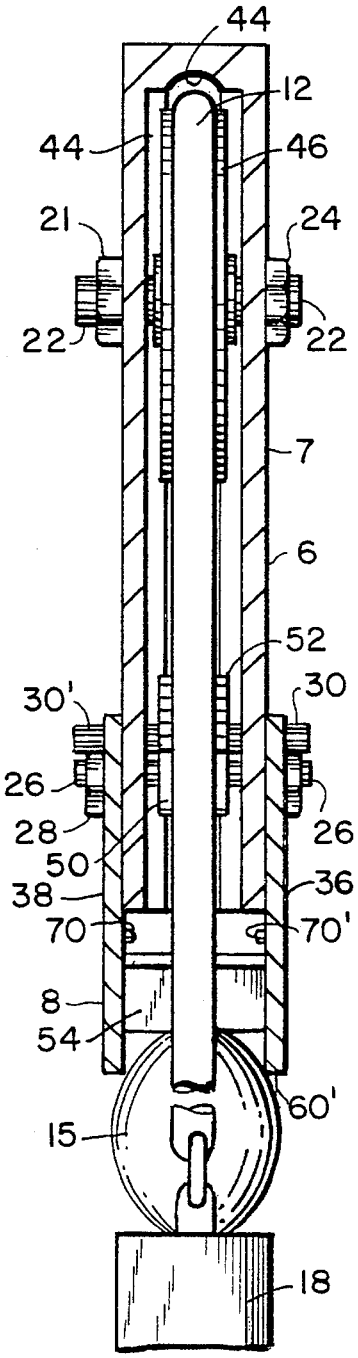
FIG. 5 is a sectional view taken along lines 5—5 of FIG. 4.

When the stop 15 engages the outer corners 62 and 62' of the lower edges 60 and 60' of walls 38 and 36 of the lever 8 it tilts the lever 8 to the position shown in FIGS. 4 and 5, causing the pins 30 and 30' to move downwardly in arcs 32 and 32', allowing the pawl 50 to slide downwardly to reengage the cable side 16 as shown in FIGS. 1, 4, and 5.

The interior faces of sides 38 and 36 of lever 8 have small nibs 70 and 70' and 71 and 71' to engage depressions 66 and 66' and 68 and 68' in the outer faces of covers 7 and 6 of enclosure 4 frictionally hold the lever 8 in the positions shown when the stops 15 or 20 are not in engagement with the lower edges 60 and 60' of the sides 38 and 36 of the lever 8.

The operation of the device as follows:

A load 18 is placed at the end of the load side 16 of the rope 12. The pawl 50 and pins 30 and 30' are as shown in FIG. 4. A pulling force is exerted downwardly on the end 14 of the rope 12, raising the load 18 at the end of the rope section 16. If the pulling is stopped, the pawl teeth 52 engage the rope section 16 as indicated at 56 to press it against the side end of the enclosure 4 to prevent the load 18 from falling downwardly while the lifter rests.

The process is repeated until the load 18, or the stop 20, as the case may be, reaches the position shown in FIG. 6 which tilts the lever 8 to the position shown in FIGS. 6 and 7, disengaging the pawl 50 from the rope 12 on the down side 16. The lifting side 14 of the rope 12 is then released, the load 18 descends to its starting position as the rope 12 is released on the side 14. When the stop 15 reaches left sides 61 and 61' of the edges 60 and 60' of the lever 8, the lever 8 is tilted back to the position shown in FIG. 4, reengaging the pawl 50 to hold the side 16 of the rope 12 in place.

The device 2 is to be made of plastic or metal and for heavy duty operations metal is preferred.

The device is particularly useful in theatrical environments for lifting and releasing sets or back drops or removing and replacing props from stage positions.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. An automatically engaging and disengaging pawl and pulley lifting mechanism comprising a pulley carried on a first pintle mounted in a pulley enclosure, a cable entrained over said pulley, said cable having a pulling side and a lifting side, said pulley enclosure having walls spaced slightly from said cable, a pawl pivoted on a second pintle and carrying teeth at one end thereof to engage said lifting side of said cable, a pin extending from at least one side of said pawl intermediate its pivot point and said teeth and extending through an arced slot in one of the walls of said pulley enclosure, tiltable lever means pivoted at an upper end thereof on pivot means mounted on said pulley enclosure, a lower edge of said lever means extending below a bottom end of said pulley enclosure, a portion of a top edge of said lever means being engageable with said pin when said lever means is pivoted, said lower edge of said lever means being engageable with means on said lifting side of said rope and wherein said lever means is tilted when said lower edge of said lever means is engaged by said means on said lifting side thereby causing the upper edge of said lever means to move said pin in an upwardly arcing motion to pull said pawl teeth away from said cable to allow the load side to descend freely, and whereby when the opposite end of said lower edge of said lever means is engaged by stop means on the pulling side of said cable, said pawl is moved back to engage said lifting side of said cable.

* * * * *